US007251920B2

(12) United States Patent
Timmerman, Sr. et al.

(10) Patent No.: US 7,251,920 B2
(45) Date of Patent: Aug. 7, 2007

(54) LATERAL FORCE RESISTING SYSTEM

(76) Inventors: Timothy L. Timmerman, Sr., 7982 Escobedo Ave., Hesperia, CA (US) 92345; Timothy L. Timmerman, II, 7210 Lyons Ave., Hesperia, CA (US) 92345

( * ) Notice: Subject to any disclaimer, the term of this patent is extended or adjusted under 35 U.S.C. 154(b) by 340 days.

(21) Appl. No.: 09/884,709

(22) Filed: Jun. 19, 2001

(65) Prior Publication Data

US 2002/0108332 A1 Aug. 15, 2002

Related U.S. Application Data

(63) Continuation-in-part of application No. 09/697,030, filed on Oct. 25, 2000, now abandoned, which is a continuation of application No. 09/060,930, filed on Apr. 14, 1998, now Pat. No. 6,158,184.

(60) Provisional application No. 60/043,835, filed on Apr. 14, 1997.

(51) Int. Cl.
*E04C 2/38* (2006.01)

(52) U.S. Cl. ..... 52/800.13; 52/98; 52/208; 52/656.2; 137/68.27; 220/89.2; 220/203.08

(58) Field of Classification Search ..... 52/783.1, 52/799.1, 481.1, 482, 1, 98, 100, 208, 655.1, 52/665, 656.2, 506.06, 506.09, 800.1, 800.12, 52/800.17; 403/119, 205, 403; 137/68.19, 137/68.27

See application file for complete search history.

(56) References Cited

U.S. PATENT DOCUMENTS 1,849,273 A * 3/1932 Broderick
3,458,184 A * 7/1969 Schlosser
3,744,197 A * 7/1973 Wetzel, Jr. ..... 52/92
4,498,261 A * 2/1985 Wilson et al. ..... 52/1
4,612,739 A * 9/1986 Wilson ..... 52/1
4,736,554 A * 4/1988 Tyler ..... 52/105
5,240,224 A * 8/1993 Adams ..... 249/93
5,249,404 A * 10/1993 Leek et al. ..... 52/702
5,337,534 A * 8/1994 Nasca ..... 52/745.21
5,364,214 A * 11/1994 Fazekas ..... 411/358
5,402,614 A * 4/1995 Jewell ..... 52/299
5,664,388 A * 9/1997 Chapman et al. ..... 52/653.1
5,706,626 A * 1/1998 Mueller ..... 52/800.12
5,833,421 A * 11/1998 Lees et al. ..... 411/466
5,836,132 A * 11/1998 Weathersby ..... 52/702
5,867,963 A * 2/1999 Hershey ..... 52/729.4
5,870,870 A * 2/1999 Utzman ..... 52/483.1
5,904,025 A * 5/1999 Bass et al. ..... 52/741.3

(Continued)

*Primary Examiner*—Carl D. Friedman
*Assistant Examiner*—Yvonne M. Horton
(74) *Attorney, Agent, or Firm*—Paul J. Backofen, Esq.; Crockett & Crockett

(57) ABSTRACT

A lateral force resisting system includes a rigid structural panel and holdowns. A foundation bolt placement template may be used to locate and support the foundation bolts during fabrication of the foundation and to further secure the frame foundation interface. The rigid structural panel may be a vertical truss or a rigid structural frame with a wooden panel covering one side and interconnecting the members of the rigid structural frame. The wooden panel may be made up of multiple panes to tailor the response of the panel to the lateral force load. The holdowns secure the rigid structural panel to the foundation bolts and may be either a folded strap and pin embodiment or self-tightening.

10 Claims, 18 Drawing Sheets

U.S. PATENT DOCUMENTS 5,967,170 A * 10/1999 Hume et al. ..... 137/68.27
5,979,130 A * 11/1999 Gregg et al. ..... 52/295
6,006,487 A * 12/1999 Leek ..... 52/698
6,018,917 A * 2/2000 Leek ..... 52/250
6,073,413 A * 6/2000 Tongiatama ..... 52/693
6,138,425 A * 10/2000 Wendt ..... 52/506.07
6,158,184 A * 12/2000 Timmerman, Sr. et al. 52/293.3
6,264,141 B1 * 7/2001 Shim et al. ..... 244/118.5
6,308,469 B1 * 10/2001 Leung ..... 52/167.3
6,367,203 B1 * 4/2002 Graham et al. ..... 52/1
6,560,940 B2 * 5/2003 Mueller ..... 52/295
6,607,003 B1 * 8/2003 Wilson ..... 137/68.23

* cited by examiner

FIG. 11A
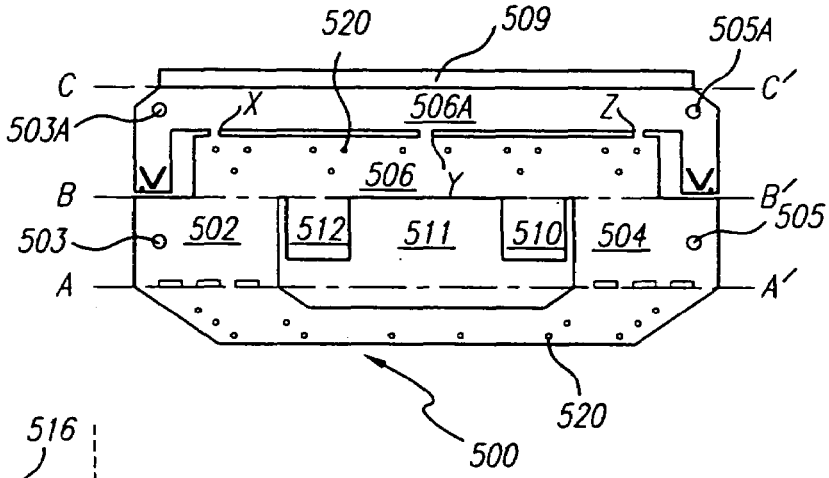
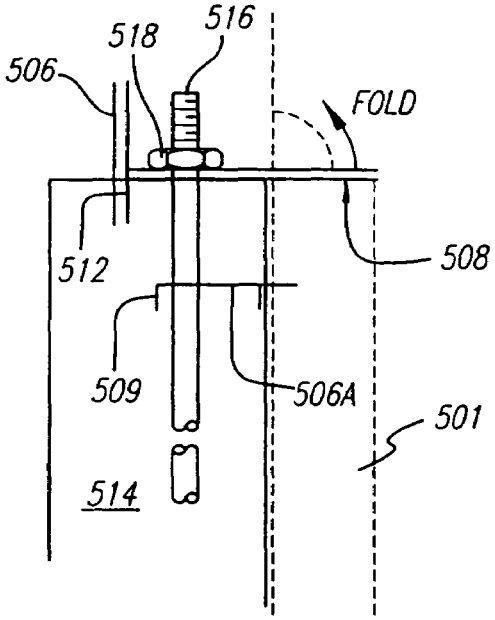
FIG. 11C
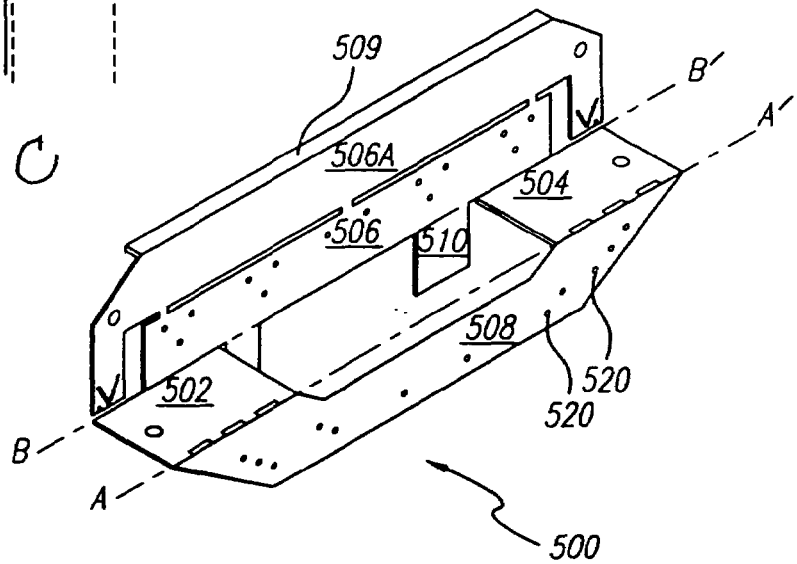
FIG. 11B

FIG. 21A
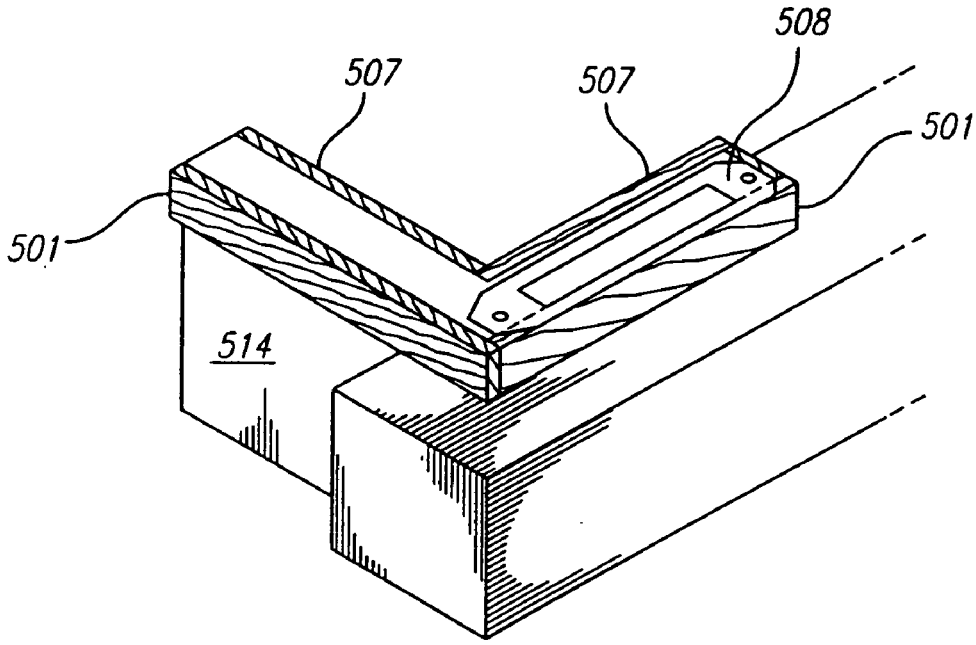
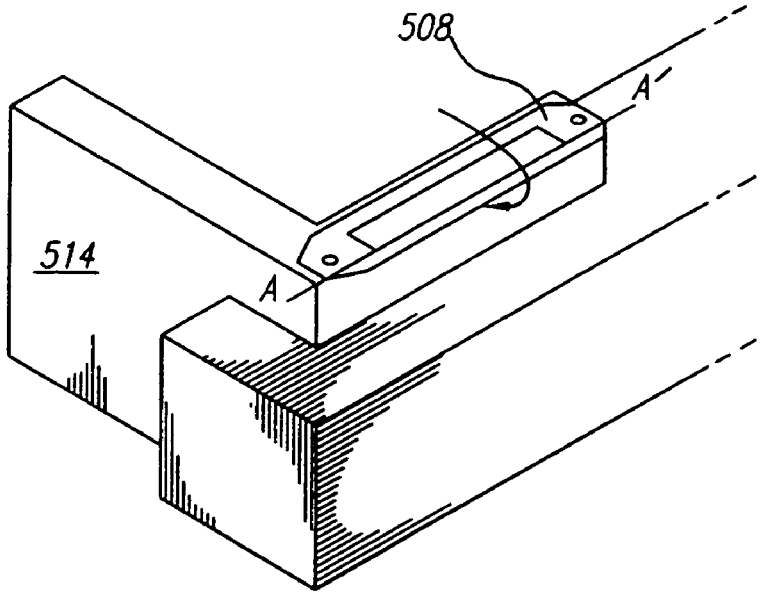
FIG. 21B

FIG. 22A
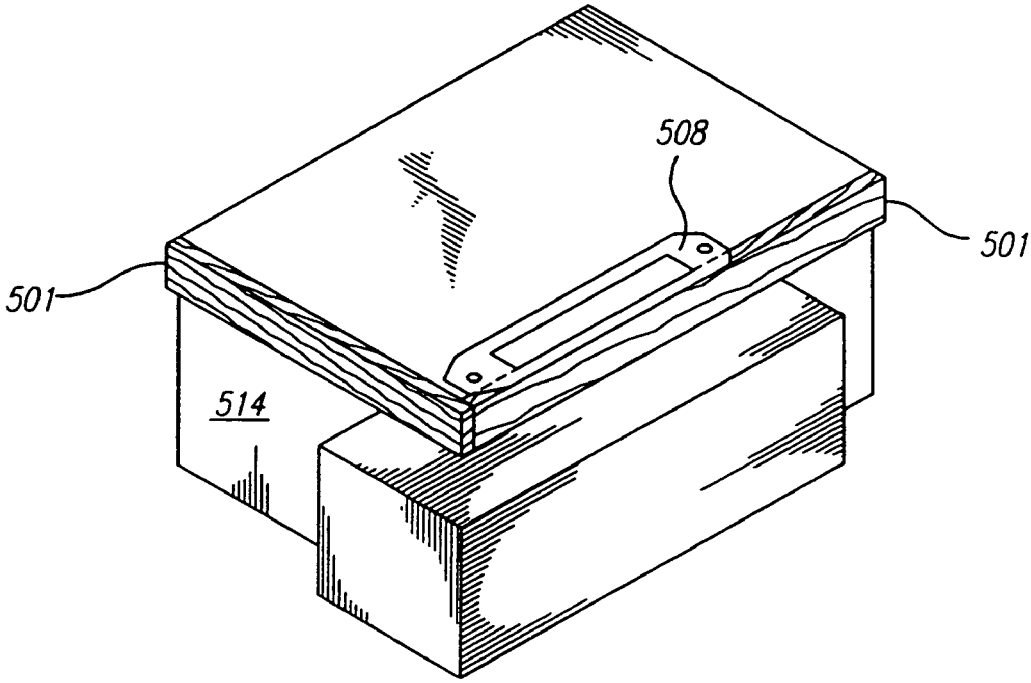
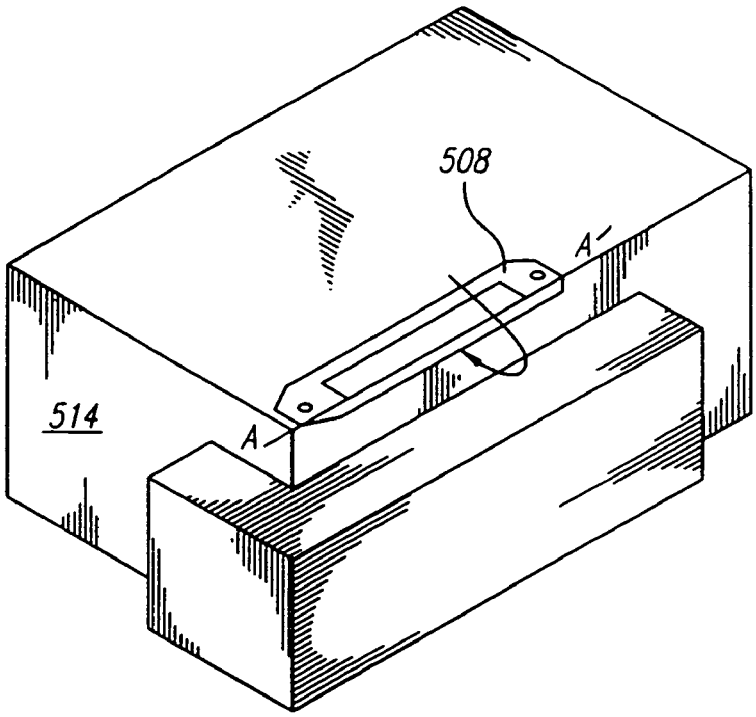
FIG. 22B

LATERAL FORCE RESISTING SYSTEM

RELATED APPLICATIONS

This application is a continuation-in-part of U.S. patent application Ser. No. 09/067,030 filed Oct. 25, 2000, now abandoned, which is a continuation of U.S. patent application Ser. No. 09/060,930 filed Apr. 14, 1998, now U.S. Pat. No. 6,158,184, which claims the priority of U.S. provisional patent application Ser. No. 60/043,835 filed Apr. 14, 1997.

BACKGROUND OF THE INVENTION

1. Field of the Invention

This invention relates generally to the field of building construction and in particular to structural framing elements for building construction.

2. Description of the Prior Art

Buildings are subjected to many forces. Among the most significant are gravity, wind, and seismic forces. Gravity is a vertically acting force, wind and seismic forces are primarily lateral (horizontal). Many buildings use shearwall diaphragms or panels to resist lateral loads. A shearwall panel is formed by the application of one or more types of sheathing such as, plywood, fiberboard, particleboard, and or drywall (gypsum board), to the inside or outside or both sides of a wall frame. The sheathing is fastened to the wall frame at many points creating a shearwall diaphragm or panel. Many suitable fasteners are available and nails are commonly used and will be referred to hereafter. The sheathed shearwall panel is used to conduct the lateral force acting on the frame of the building to the foundation.

Buildings require a strong base for support. Most buildings have a concrete base that is generally referred to as the foundation. A concrete pad whose top forms a continuous plane from edge to edge is called a slab. With a slab the concrete forms the floor of the building. The deepest concrete support that follows the perimeter of the building is called the footing. In a building without a concrete floor, the floor may be supported by short concrete walls called stem walls that are supported by the footing. Some grading considerations or design requirements necessitate a hybrid of a slab and a stem wall. This results in the use of short concrete walls extending from a few inches to a few feet above the level of the concrete floor. Foundation will be used hereafter in place of stem wall, footing, and slab.

The site where the building is to be erected is first graded (leveled). Wooden boards are nailed together to create a 'form' or mold for the foundation (slab, footing, stem wall). The forms mark the edges of the foundation. Next, wet concrete is poured into the form and the surface is smoothed and the concrete is allowed to harden. As the concrete hardens, bolts are partially imbedded in the top of the foundation with the threaded end of each bolt protruding out of the foundation. The bolts are embedded wherever a wall will contact the foundation/stem wall to provide a means of securing the wall to the foundation.

The frame of the walls is fabricated next. Each wall frame section is composed of several elements. In North America, the wall frames of most homes and small buildings use wood or metal elements having cross sectional dimensions of 2"×4", 2"×6", or 2"×8". At the base of a wall frame is an element called a mudsill, and wood or metal stud elements are attached on top of, and perpendicular to, the mudsill. On top of the studs is a top plate that is secured to each stud. Holes are drilled through the mudsill for the foundation bolts to pass through the mudsill. After the wall frame elements are connected together, the wall frame is tilted to a vertical orientation. The wall frame is put in its finished location with the foundation bolts protruding through the holes drilled in the mudsill. Once adjacent wall frames are in place, they are secured together at the corners and an additional plate (top cap) may be added which overlaps the top plates of adjacent wall frames.

After the building frame is completed, the building is ready to be sheathed. Conventional building construction uses sheathing inside a building (drywall) which forms the wall surface which we all see, and sheathing on the roof which helps keep the building dry. Plywood or other sheathing is also applied to the outside and sometimes the inside walls of every building. The panel created by many fasteners attached through the plywood or drywall into the supporting wall studs, mud sill and top plates creates a sturdy vertical diaphragm known as a sheathed shearwall. Drywall or gypsum sheathing provides insulation and fire resistance and some structural stability. The structural contribution of a drywall panel is limited because of the relatively delicate composition of the drywall. Where higher lateral force resistance is required, builders and designers generally use plywood or particleboard or fiberboard or metal sheathing fastened to the wall frame. Plywood is the most common choice and will be discussed hereafter, but other suitable materials may be used. Plywood is available in 4'×8' sheets that vary from ¼" to over 1" in thickness. Plywood is composed of many thin layers of wood glued together under pressure with the grain pattern of adjacent layers perpendicular to each other for strength.

Review of damage following the Northridge earthquake, revealed that many plywood sheathed shearwalls failed under the seismic forces. The nailing of the sheathing in the field during construction leads to many failures. Nails driven through the sheathing miss the frame member they were intended to penetrate creating 'shiners'. Nail heads penetrate the skin of the sheathing during nailing which weakens the sheathing and allows the nails to be pulled through the sheathing under load conditions as well as inducing failures in the integrity of the sheathing. Shearwall fabrication requires regular nail spacing of 3"–12" depending on the design requirements. Current field fabrication techniques are not sufficiently accurate to consistently meet the design specifications. Therefore every shearwall panel may be nailed differently and many may be installed with fewer nails than required to handle the required design load.

The rise in land prices has caused the building of more multiple floor dwellings to raise housing density. Multiple floors significantly increase lateral loads and thus increase the use of field fabricated sheathed shearwalls. In many multiple story buildings the entire outside of the building may be sheathed.

Consequently, many building departments may be limiting sheathed shearwalls to a maximum height/width ratio of 2:1. Where walls are typically eight feet high, the minimum shearwall width would be four feet. This restriction has implications throughout a building. At the front of a garage narrow shearwalls, two to three foot wide, are common. Narrow sheathed shearwalls are also common adjacent to window and door openings.

The interface between the shearwall and the foundation may also be area of weakness. The conventional practice of locating holdowns within the framework of a sheathed shearwall weakens the sheer wall and the frame-foundation interface. Bolts imbedded in the concrete of the foundation provide attachment points for the walls and shear panels. These bolts are intended to pass through the mudsill of the sheathed shearwall to prevent lateral movement between the sheathed shearwall and the foundation. The foundation bolts also transfer the lateral load from the top of the sheathed shearwall to the foundation. Quite often the bolts which are supposed to secure the walls and shear panels are placed several inches away from where they are required for optimum load transfer and ease of wall construction due to inaccurate measuring and carelessness during field installation of the bolts. The resulting misalignment forces some of the framing members to be trimmed to fit, or in some cases, the intended foundation bolt must be cut off and an epoxy bolt or a "red head" must be used. The resulting attachment of the wall to the foundation is a potential point of failure.

Another common fabrication error is oversize holes in the mudsill. The mudsill is the base member of a wall frame that is in direct contact with the foundation. Many different causes result in holes in the mud sill which don't line up with the bolts placed in the foundation or in the stem wall. This requires extra holes, or oversize or elongated holes be created in the mud sill which may weaken the frame-foundation interface.

The attachment hardware that may be used to connect a shearwall to the foundation may be another point of weakness. If a field-fabricated shearwall were ever built in exact compliance with the design, the attachment hardware would likely fail before the shearwall. In most cases the attachment hardware is fabricated by folding steel strips with a few tack welds. In practice the folds provide the necessary flex in the attachment hardware to induce failure. In other cases, the method of attaching the attachment hardware to the studs induces cracking of the studs.

What is needed is an alternative to field fabricated wooden shear walls that has the ductility and simplicity of wood construction combined with the higher load capacities and consistency of steel products.

SUMMARY OF THE INVENTION

In accordance with the present invention, lateral force resistance of a building frame may be improved by substituting a manufactured steel lateral force resisting system, which includes a tailored ductility structural panel and may include holdowns, in place of each conventional sheathed shearwall. In addition, a foundation bolt placement template may also be used. The lateral force resisting system may be used in wood frame as well as metal frame buildings.

In another aspect of the present invention, a tailored ductility lateral force resisting system according to the present invention may incorporate one or more lateral load damping elements to generate a tailored ductile response to lateral loading and resist catastrophic failure.

These and other features and advantages of this invention will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIG. 11(*a*) is a top view of a currently preferred embodiment of a foundation bolt placement template according to the present invention.

FIG. 11(*b*) is a perspective view of the foundation bolt placement template of FIG. 11(*a*).

FIG. 11(*c*) is an end view of the foundation bolt placement template of FIG. 11(*a*).

FIG. 19(*b*) is an exploded perspective view of the self-tightening holdown of FIG. 17(*a*).

FIGS. 21(*a*)–(*b*) are perspective views of a stem wall foundation corner according to one aspect of the present invention.

FIGS. 22(*a*)–(*b*) are perspective views of a slab foundation corner according to a second aspect of the present invention.

DETAILED DESCRIPTION OF THE PREFERRED EMBODIMENT(S)

Figure 3:
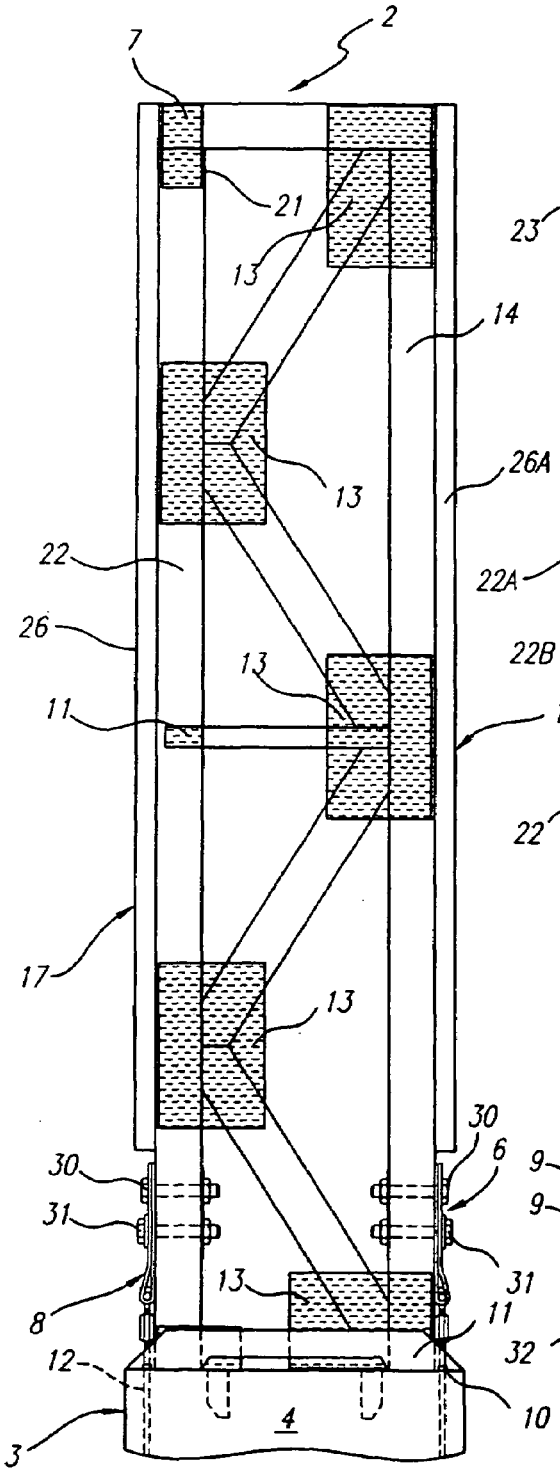
FIG. 3 is a front view of a another alternate embodiment of the present invention.
Figure 4:
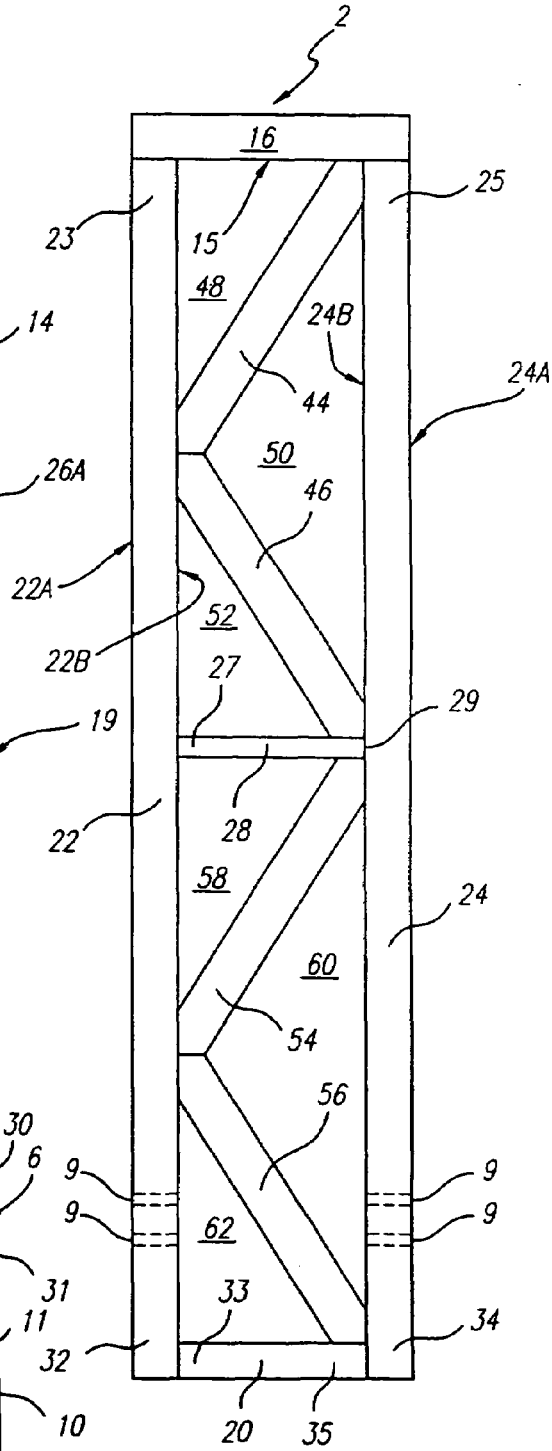
FIG. 4 is a front view of an embodiment of a rigid structural frame.

Referring now to FIG. 3, a front view of a currently preferred embodiment of the present invention, showing rigid structural panel 2, secured to foundation 4, by foundation bolt placement template 14 and holdowns 6 and 8 engaged to foundation bolts 10 and 12 respectively. Furring boards 26 and 26A are attached to first side member 22 and second side member 24 respectively. As shown in FIG. 4, furring boards 26 and 26A enable stud 115 and trimmer 114 to be solidly attached at side 17 and side 19 respectively.

Referring now to FIG. 4, a front view of one aspect of the present invention is shown. Rigid structural panel 2 is configured as a vertical truss for applications requiring a 1–3½ foot wide lateral force resistance panel. Sill plate 20 forms the base of rigid structural panel 2. Sill plate 20 is perpendicular to first side member 22. First side member 22 is parallel to second side member 24. First end 33 of sill plate 20 abuts bottom end 32 of first side member 22. Second end 35 of sill plate 20 abuts bottom end 34 of second side member 24. Top member 16 is perpendicular to first side member 22 and second side member 24. Bottom side 15 of top member 16 abuts top end 23 of first side member 22, and bottom side 15 similarly abuts top end 25 of second side member 24. Horizontal spacing member 28 is approximately equidistant between top member 16 and sill plate 20. First end 27 and second end 29 of horizontal spacing member 28 abut first side member 22 and second side member 24 respectively. Within the rectangle formed by top member 16, first side member 22, second side member 24 and horizontal spacing member 28, are a plurality of web members which form structural support triangles. First web member 44 and second web member 46 form structural support triangles 48, 50, and 52. Within the rectangle formed by sill plate 20, first side member 22, and horizontal spacing member 28, and second side member 24 are web member 54 and web member 56, which form triangles such as structural support triangles 58, 60, and 62.

Rigid structural panel 2 may include horizontal spacing member 28, however a suitable rigid structural panel may not include a horizontal spacing member. Horizontal spacing member 28 simplifies the fabrication of the rigid structural panel by bracing the vertical side members during fabrication. The horizontal dimensions of rigid structural panels fabricated with a horizontal spacing member(s) 28 are more consistent because a bow in first side member 22 or in second side member 24 may be removed during fabrication.

In another aspect of the present invention, near bottom end 32 of first side member 22 and bottom end 34 of second side member 24, are transverse holes 9, parallel to sill plate 20. Holes 9 accept bolts such as bolt 30 for attaching holdowns such as holdown 6 and holdown 8 as shown in FIG. 3.

Figures 1A, 1B:
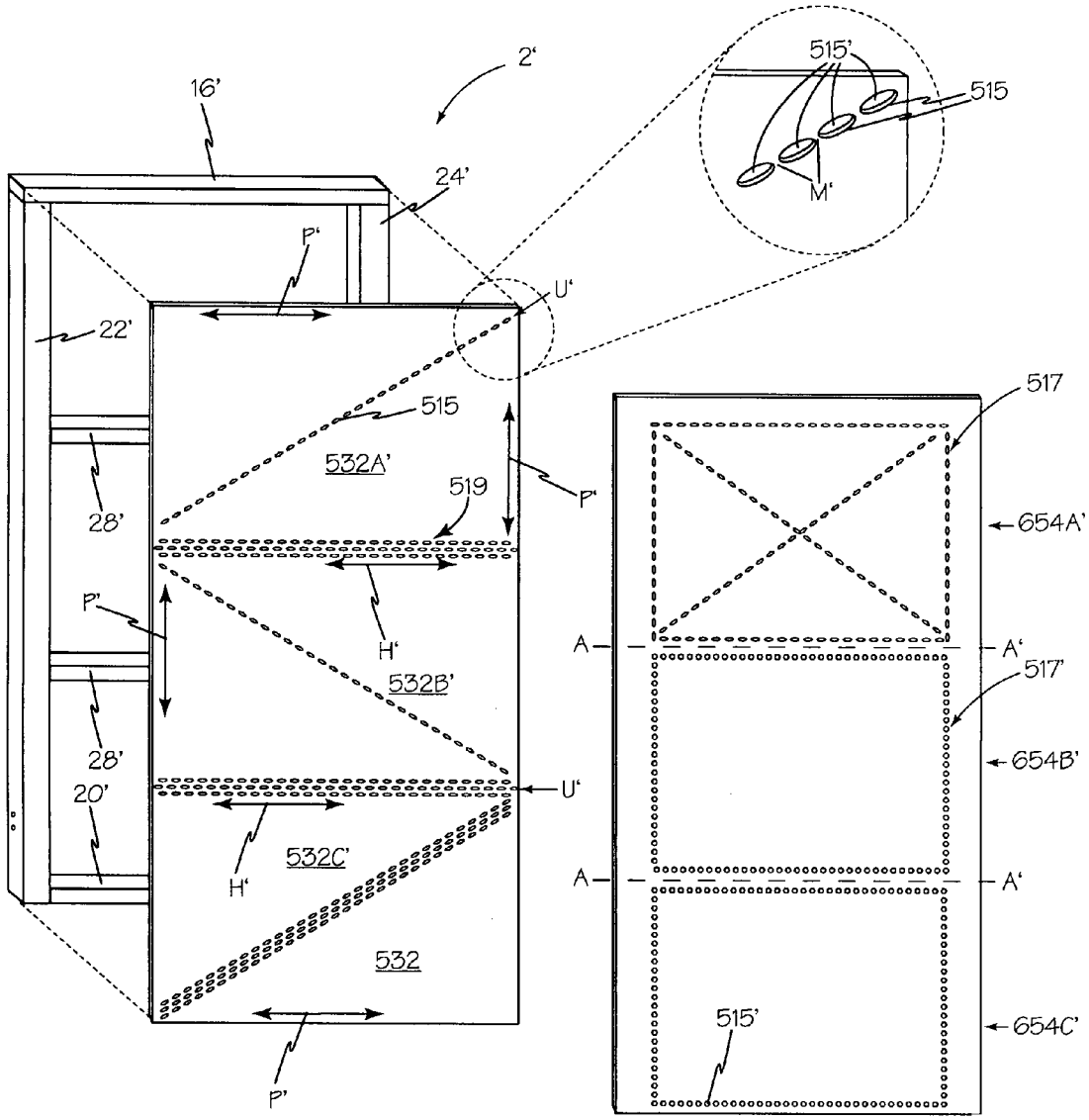
FIG. 1A is an exploded perspective view of a rigid structural frame according to the present invention.
FIG. 1B is a front view of an alternate embodiment of a lateral load damping element according to the present invention.

Referring now to FIGS. 1A and 1B, in a currently preferred embodiment of the present invention rigid structural panel 2' may include elements made of steel or other similar material instead of wood. Rigid structural panel 2' may include first side member 22', second side member 24', top member 16', sill plate 20' and one or more horizontal spacing members 28' which may all be C-channel elements. Other element geometries such as square or rectangular may be used. Panel 532' may function as a lateral force resisting element in the present invention. Panel 532' may be permanently or removable secured to rigid structural panel 2' along perimeter P' and also to horizontal spacing members 28' along H'. Panel 532' may also be subdivided into sub panels 532A', 532B' and 532C' by attachment along H' and or load strips 519. Tailored ductility of rigid structural panel 2' may be achieved using one or more load points 515 cut or otherwise opened through panel 532'. Load points such as load point 515 may have many suitable shapes such as but not limited to squares, rectangles, ovals and circles 515' and may be arranged into patterns such as pattern 517 or 517', or grouped into parallel units U'. Material M' surrounding load points 515 may serve to absorb lateral loading and deform without causing out of plane deflection of rigid structural panel 2'. Load point 515 may be formed by removing material 515' or by cutting and bending the material of panel 532' to form vent style openings.

Figure 2A:
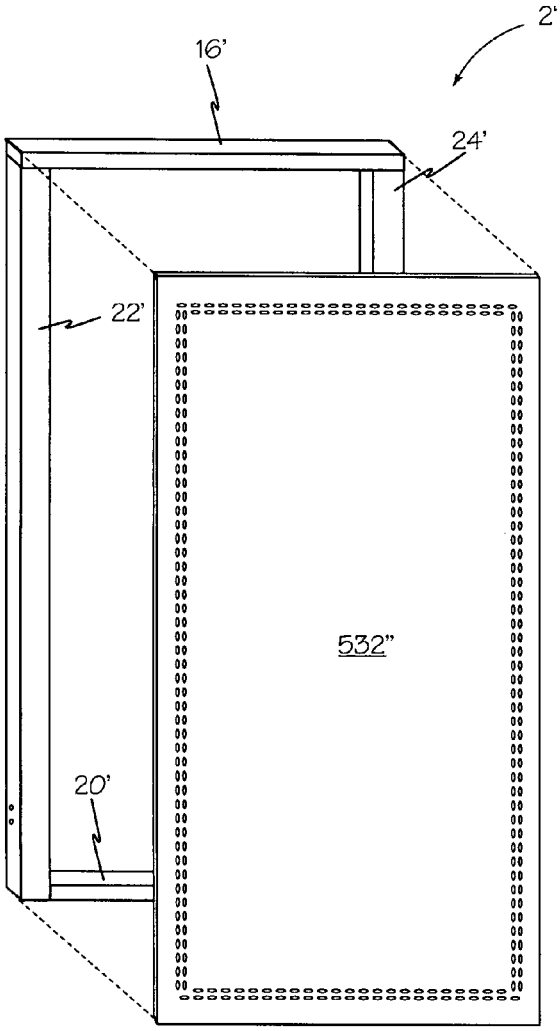
FIG. 2A is an exploded perspective view of alternate embodiment of a rigid structural frame according to the present invention.
Figure 2B:
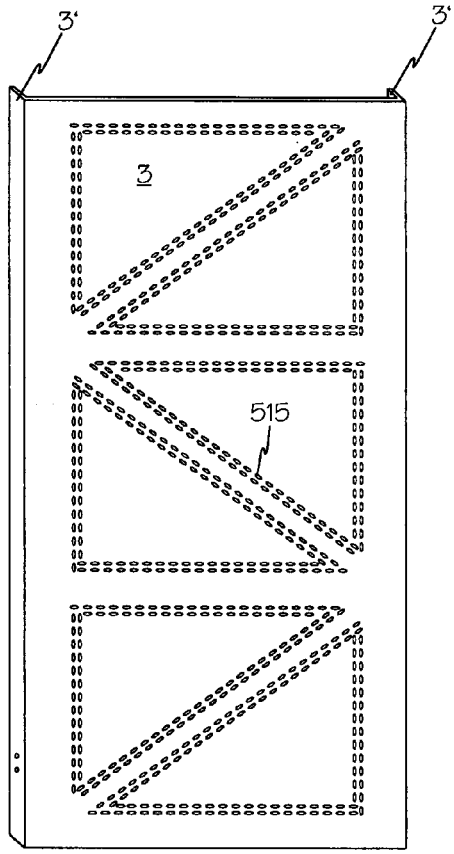
FIG. 2B is a front view of an alternate embodiment of a lateral load damping element according to the present invention.

Referring now to FIGS. 2A and 2B, in an alternate embodiment of the present invention, rigid structural panel 2 includes only first side member 22', second side member 24', top member 16', sill plate 20' and one or more horizontal spacing members 28'. Panel 532" may be a single element that may be subdivided using load points 515 as shown in FIG. 2B.

Figure 5:
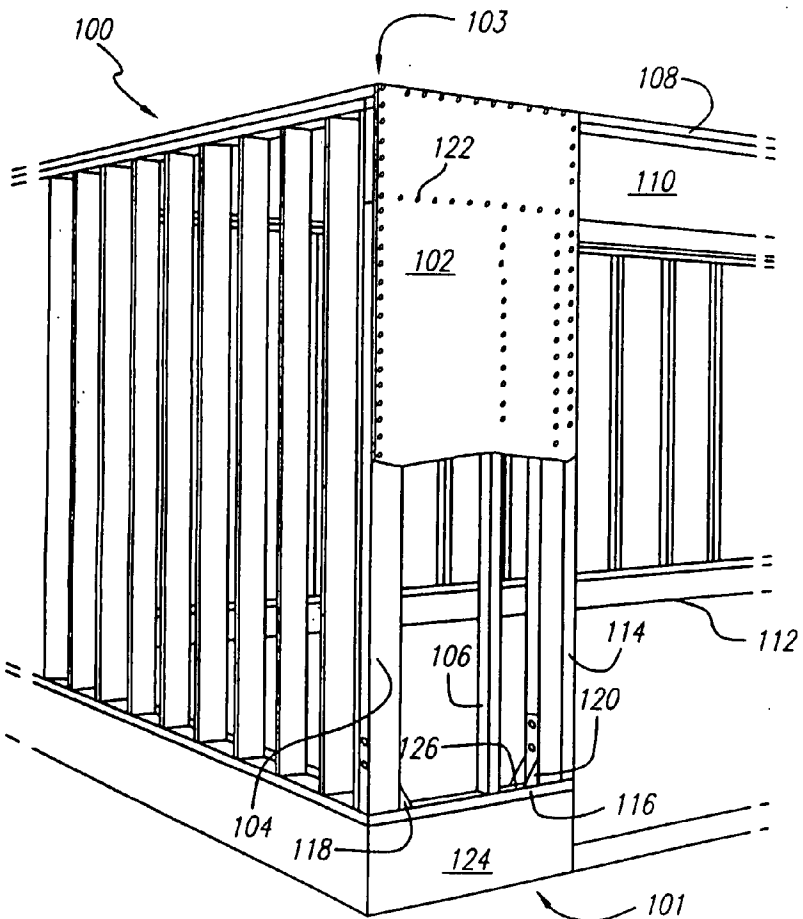
FIG. 5 PRIOR ART
FIG. 5 is a perspective view of the prior art wood framing techniques showing the elements of a building frame and a section of a sheathed shearwall.

Referring now to FIG. 5, building frame 100 is an example of conventional building framing. Shearwall 101 is formed by fastening sheathing 102 to corner post 104, stud 106, top cap 108, header 110, post 112, trimmer 114 and mud sill 116. Sheathing 102 may be fastened to frame members 104–116 in any conventional manner such as nails or screws. A plurality of fasteners 122 attach sheathing 102 to frame members 104–116, at regular intervals along frame members 104–116 and along periphery 103 of sheathing 102. Holdowns 118 and 120 are secured to corner post 104 and post 112, respectively, within shearwall 101. Holdown 118 and 120 are secured to foundation 124 by a bolt, such as bolt 126, shown penetrating holdown 120 and mud sill 116.

Figure 6:
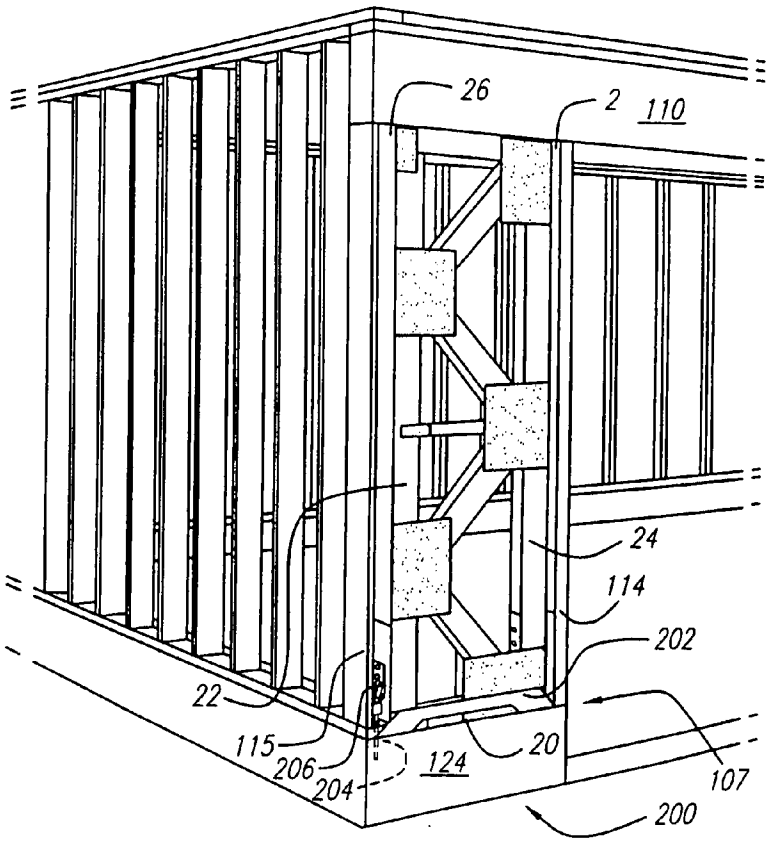
FIG. 6 is a perspective view of FIG. 3 embodiment of the present invention integrated in a building frame as a replacement for a section of a sheathed shearwall.

Referring now to FIG. 6, the present invention is shown as a replacement for shearwall 101. In this embodiment, rigid structural panel 200 is configured as a vertical truss and provides vertical support for header 110. Foundation bolt placement template 202 locates and supports foundation bolts such as bolt 204 during fabrication of foundation 124. Foundation bolt placement template 202 also attaches to sill plate 20, bottom end 32 of first side member 22, and bottom end 34 of second side member 24 to further secure frame-foundation interface 107. Two holdowns such as holdown 206 are attached to the outside of panel 200 to further secure panel 200 to foundation 124.

Figure 7:
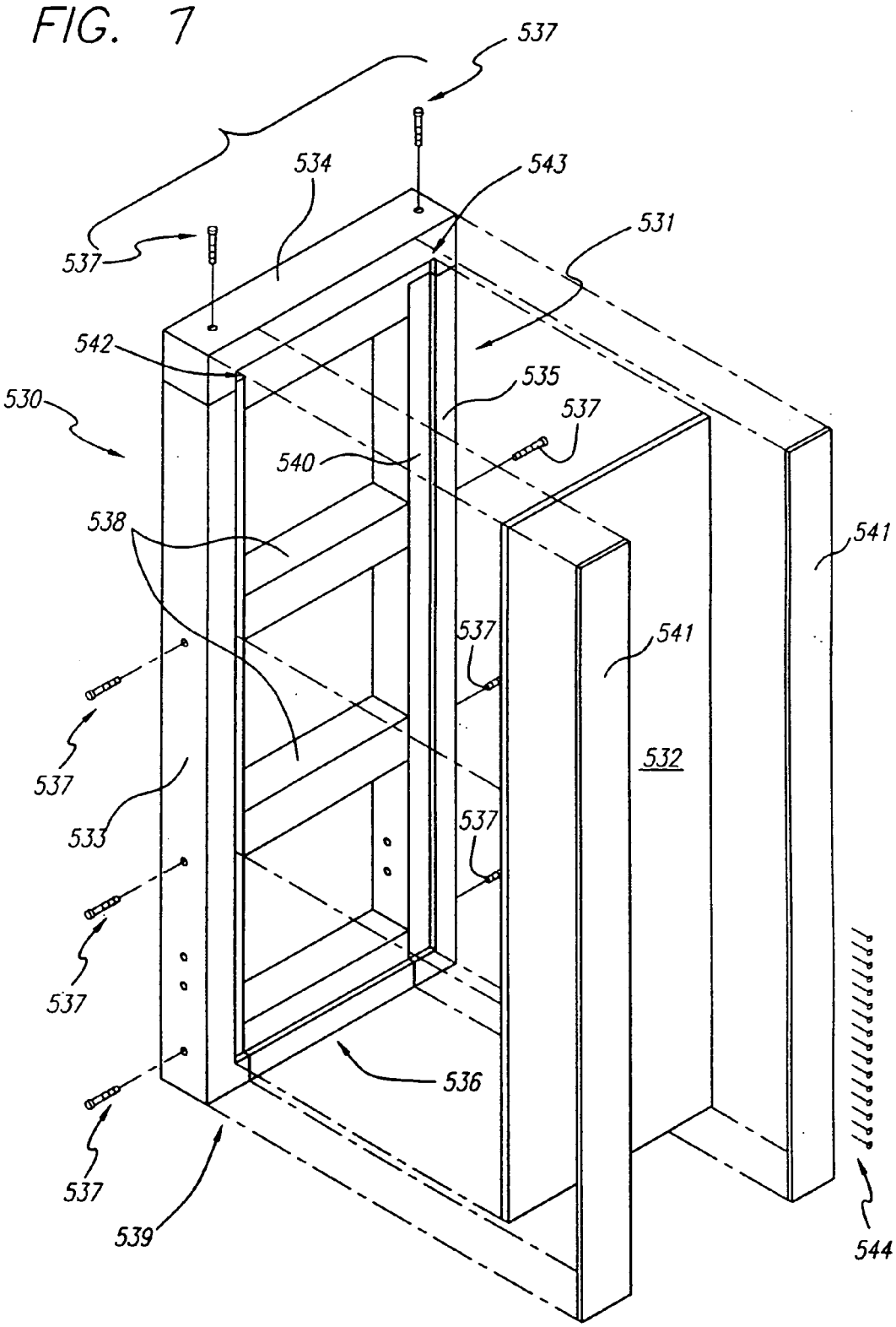
FIG. 7 is a perspective view of a second embodiment of a rigid structural panel.

Referring now to FIG. 7, in a currently preferred embodiment of the present invention rigid structural panel 530 is configured as a generally rectangular frame 531 covered on side 539 by a panel 532. In this configuration first vertical side member 533 and second vertical side member 535 are connected by top end 534 and bottom end 536. The interior opening may be divided by one or more interior dividers 538. The elements of rectangular frame 531 are connected together by any conventional connector, here bolts 537 are used. Panel 532 is attached to side 539 using any conventional fasteners. In a currently preferred embodiment of the present invention panel 532 is an oriented strand board (OSB) panel and is inset into dado 540 in rectangular frame 531. Plates 541 are fastened over joints 542 and 543 formed between panel 532 and frame 531. Any conventional fastener 544 may be used to attach plates 541, here fasteners 544 are #10 common galvanized nails are every 4". In a currently preferred embodiment of the present invention plates 541 are 20 gauge galvanized steel however, other suitable materials may be used.

Figure 8:
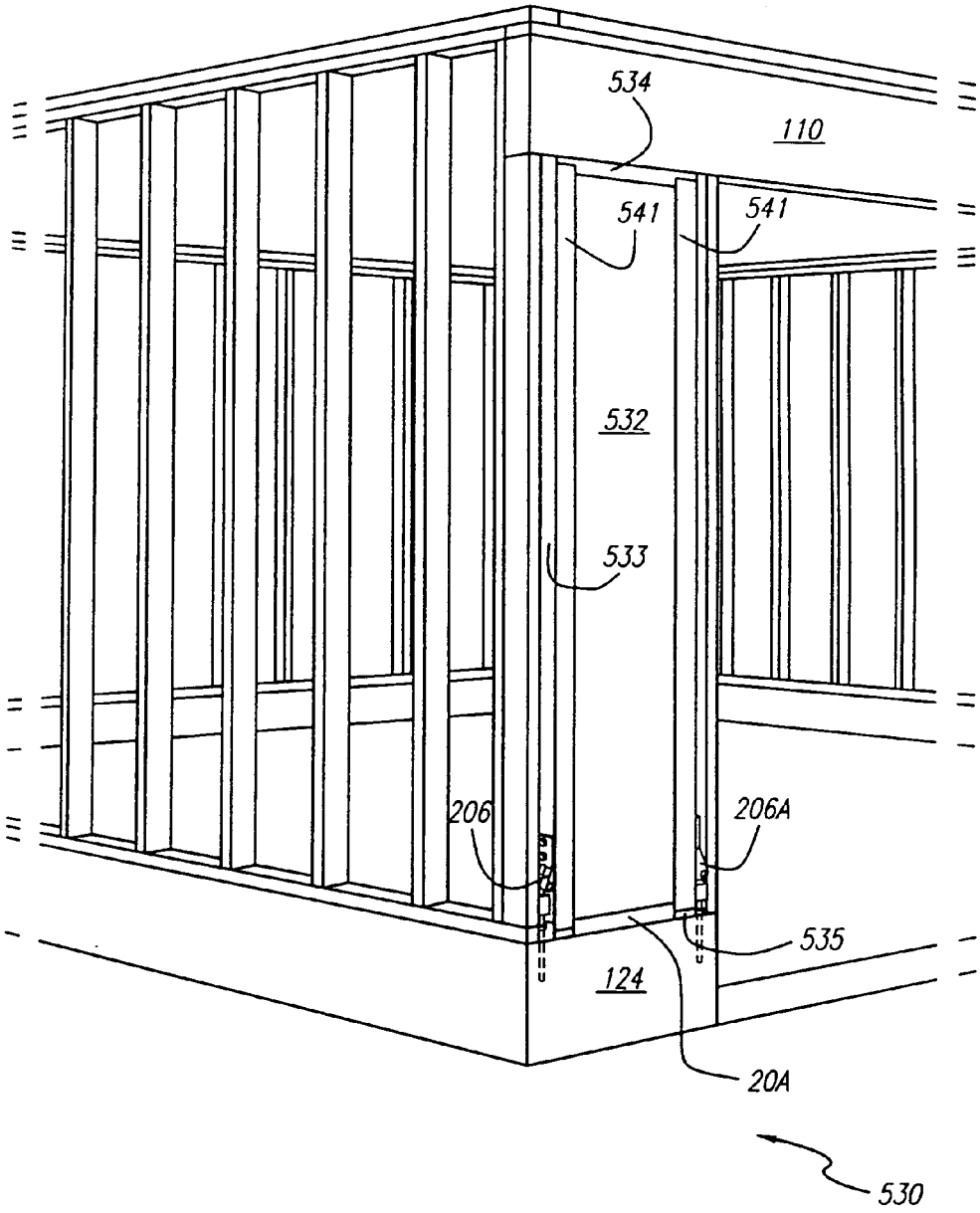
FIG. 8 is a perspective view of FIG. 7 embodiment of the present invention integrated in a building frame as a replacement for a section of a sheathed shearwall.

Referring now to FIG. 8, the present invention is shown as a replacement for shearwall 101. In this embodiment, rigid structural panel 530 provides vertical support for header 110. Holdowns 206 and 206A are attached to first vertical side member 533 and second vertical side member 535 respectively, to secure rigid structural panel 530 to foundation 124. rigid structural panel 530 may be secured to foundation 124 without the use of a foundation bolt placement template.

Figure 9:
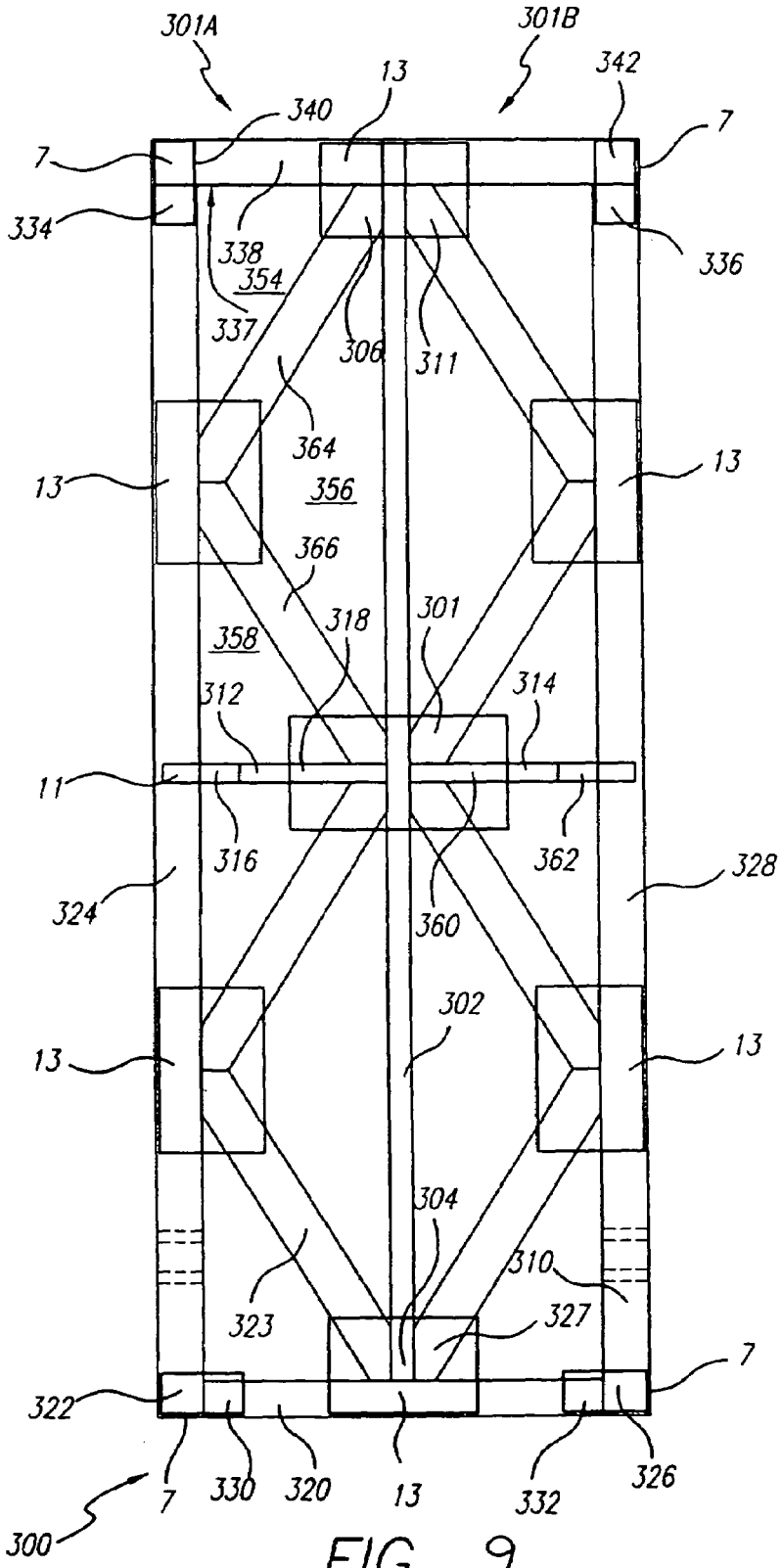
FIG. 9 is a front view of a an alternate embodiment of a rigid structural panel.

Referring now to FIG. 9, another aspect of the present invention is shown in which rigid structural panel 300 is configured for applications requiring a 3½–6½ foot wide lateral force resistance panel. Rigid structural panel 300 includes sill plate 320, perpendicular to first side member 324, first end 330 of sill plate 320 abuts side 323 of bottom end 322 of first side member 324. Sill plate 320 is also perpendicular to second side member 328, second end 332 of sill plate 320, abuts side 327 of bottom end 326 of second side member 328. First side member 324 is parallel to second side member 328. Vertical support 302 is perpendicular to sill plate 320, bottom end 304 of vertical support 302 abuts top center 310 of sill plate 320. Top member 338 is perpendicular to first side member 324, bottom side 337 of first end 340 of top member 338, abuts top end 334 of first member 324. Top member 338 is perpendicular to vertical support 302, bottom point 311 of top member 338 abuts top end 306 of vertical support 302. Top member 338 is also perpendicular to second side member 328, bottom side 337 of second end 342 abuts top end 336 of second side member 328. Horizontal spacing member 312 is about equidistant between sill plate 320 and top member 338. First end 316 of horizontal spacing member 312 abuts first side member 324 and second end 318 of horizontal spacing member 312 abuts vertical support 302. Horizontal spacing member 314 is about equidistant between sill plate 320 and 338. First end 360 of horizontal spacing member 314 abuts vertical support 302 and second end 362 of horizontal spacing member 314 abuts second side member 328. A plurality of rectangles are formed by the arrangement of first side member 324, second side member top member 338, second side member 328, sill plate 320, vertical support 302 and horizontal spacing members 312 and 314. Within each rectangle thus formed, are a plurality of web members forming structural triangles. For example, within the rectangle formed by first side member 324, top member 338, vertical support 302 and spacing member 312 are web members 364 and 366 which form triangles such as structural triangles 354, 356 and 358. The angular orientation of adjacent web members, and the orientation of web members in adjacent rectangles alternates as shown.

In an alternate embodiment, vertical support 302 may be a 4"×4" member. Rectangle 301A formed by first side member 324, top member 338, vertical support 302 and sill plate 320 is covered by a panel 532. Adjacent rectangle 301B formed by second side member 328, top member 338, vertical support 302 and sill plate 320 is covered by a panel 532.

Rigid structural panel 300 may include a plurality of horizontal spacing members such as horizontal spacing members 312 and 314. The addition of horizontal spacing members 312 and 314 simplifies the fabrication of the rigid structural panel by bracing first and second side members 324 and 328 and vertical support 302 during fabrication. The horizontal dimension of a rigid structural panel is more consistent using horizontal spacing members 312 and 314, because a bow in first side member 312, or in second side member 314, or in vertical support 302 may be removed during fabrication. Horizontal spacing members may be included and secured as shown in FIG. 7.

Referring more specifically to FIGS. 1, 7, and 8, in another aspect of the present invention, every joint such as joint 21 of rigid structural panel 2, where two or more members join, a truss plate or gang nail plate, such as truss plate 7 is pressed into each face of the joint which is common to all the members of the joint, that is, the front and back of the joint, to secure the joint. A 20 Ga. truss plate such as plates 7 and 11 is used for joints of only two members. A joint of three or four members uses an 18 Ga. truss plate such as plate 13. A joint of five or more members uses a 16 Ga. truss plate such as plate 301 of FIGS. 7 and 8.

Figure 10:
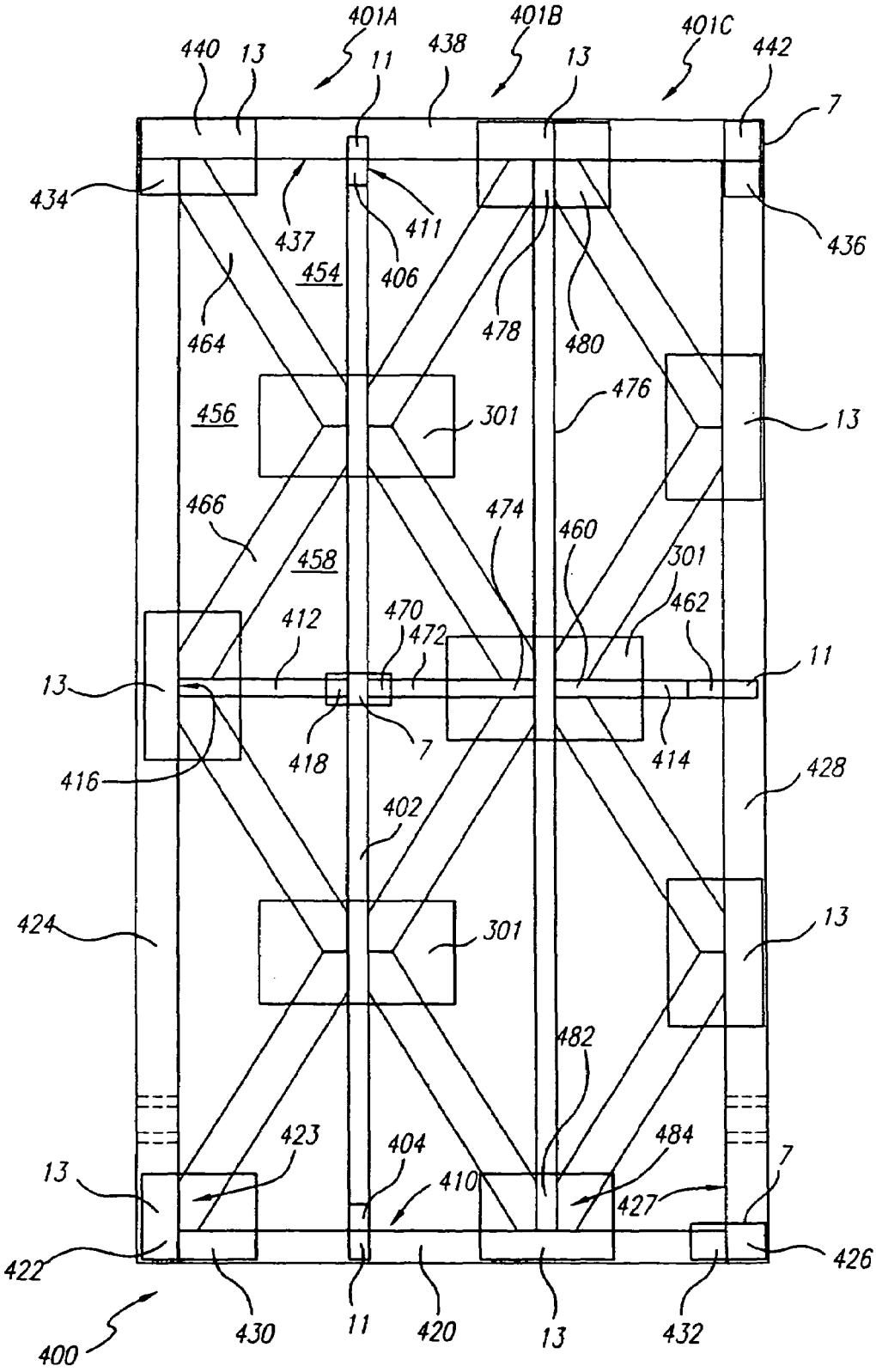
FIG. 10 is a front view of another alternate embodiment of a rigid structural panel.

Referring now to FIG. 10, another aspect of the present invention is shown in which rigid structural panel 400 is configured for applications requiring a 5½–8 ½ foot wide lateral force resistance panel. Rigid structural panel 400 includes sill plate 420, perpendicular to first side member 424, first end 430 of sill plate 420 abuts side 423 of bottom end 422 of first side member 424. Sill plate 420 is also perpendicular to second side member 428, second end 432 of sill plate 420, abuts side 427 of bottom end 426 of second side member 428. First side member 424 is parallel to second side member 428. Vertical support 402 is perpendicular to sill plate 420, bottom end 404 of first vertical support 402 abuts top point 410 of sill plate 420. Second vertical support 476 is perpendicular to sill plate 420 bottom end 482 of second vertical support 476 abuts top point 484 of sill plate 420. Top member 438 is perpendicular to first side member 424 bottom side 437 of first end 440 of top member 438, abuts top end 434 of first side member 424. Top member 438 is perpendicular to first vertical support 402 bottom point 411 of top member 438 abuts top end 406 of first vertical support 402. Top member 438 is perpendicular to second vertical support 476 bottom point 480 of top member 438 abuts top end 478 of second vertical support 476. Top member 438 is also perpendicular to second side member 428 bottom side 437 of second end 442 abuts top end 436 of second side member 428. Horizontal spacing members 412, 472, and 414 are about equidistant between sill plate 420 and top member 438. First end 416 of horizontal spacing member 412 abuts first side member 424, and second end 418 of horizontal spacing member 412 abuts first vertical support 402. First end 470 of horizontal spacing member 472 abuts first vertical support 402, and second end 474 of horizontal spacing member 472 abuts second vertical support 476. First end 460 of spacing member 414 abuts second vertical support 476, and second end 462 of spacing member 414 abuts second side member 428. A plurality of horizontally adjacent rectangles are formed by the arrangement of first side member 424, second side member top member 438, second side member 428, sill plate 420, first vertical support 402 and horizontal spacing members 412 and 414. Within each rectangle thus formed, a plurality of web members form structural triangles. For example, within the rectangle formed by first side member 424, top member 438, first vertical support 402 and spacing member 412 are web members 464 and 466 which form triangles such as structural triangles 454, 456 and 458.

In an alternate embodiment, vertical supports 402 and 476 may be 4"×4" members. Rectangle 401A formed by first side member 424, top member 438, vertical support 402 and sill plate 420 is covered by a panel 532. Horizontally adjacent rectangle 401B is formed by vertical support 476, top member 338, vertical support 402 and sill plate 420 is covered by a panel 532. Rectangle 401C formed by second side member 428, top member 438, vertical support 476 and sill plate 420 is covered by a panel 532.

Rigid structural panel 400 may include a plurality of horizontal spacing members such as horizontal spacing members 412, 414 and 472. The addition of horizontal spacing members 412, 414 and 472 simplifies the fabrication of the rigid structural panel by bracing first and second side members 424 and 428 and vertical supports 402 and 476 during fabrication. The horizontal dimension of a rigid structural panel is more consistent using horizontal spacing members 412, 414 and 472, because a bow in first side member 412, or in second side member 424, or in vertical support 402 or 476 may be removed during fabrication. Horizontal spacing members may be included and secured as shown in FIG. 7.

Figure 12:
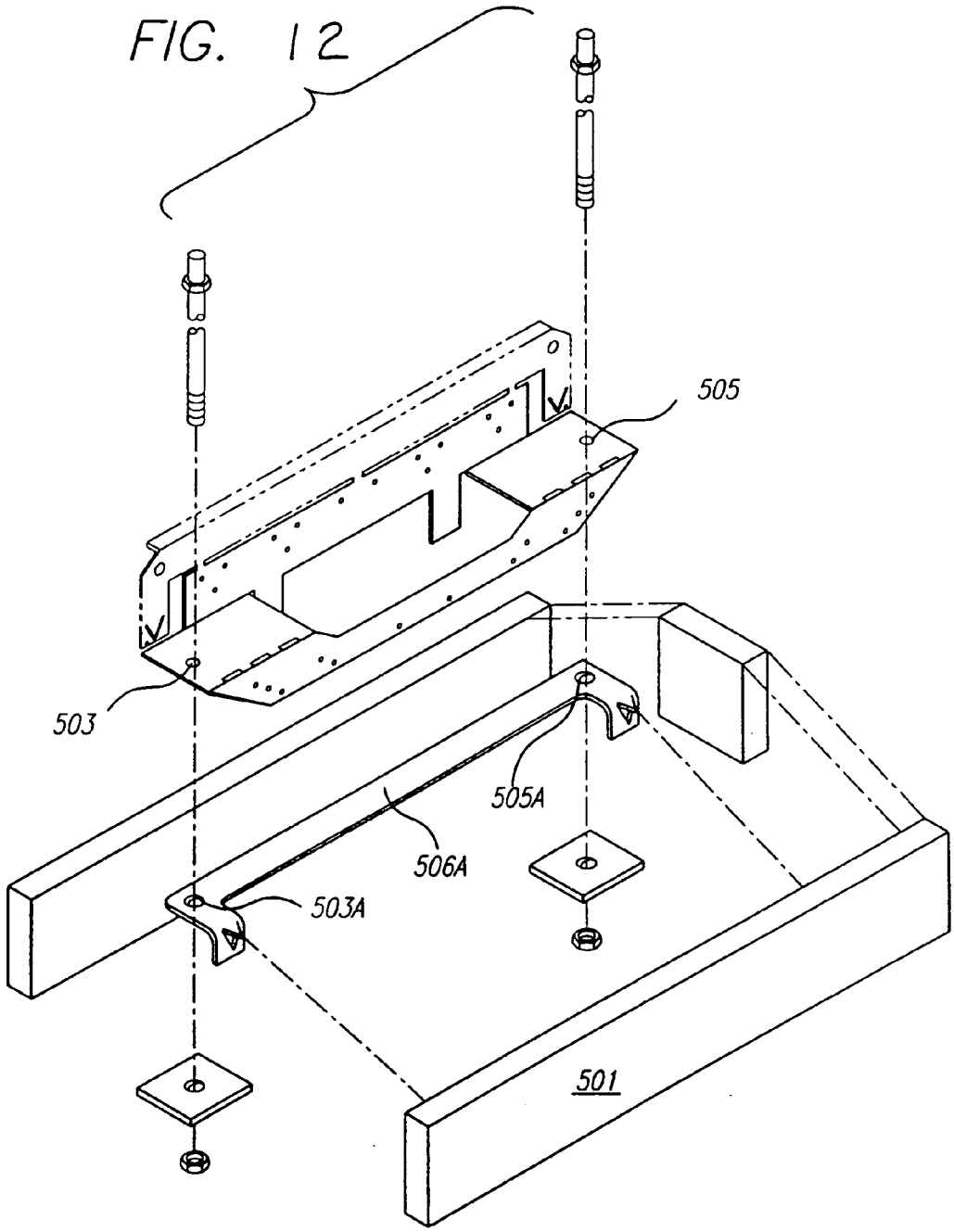
FIG. 12 is an exploded perspective view of the foundation bolt placement template of FIGS. 11(*a*)–(*c*) showing the installation.
Figure 13:
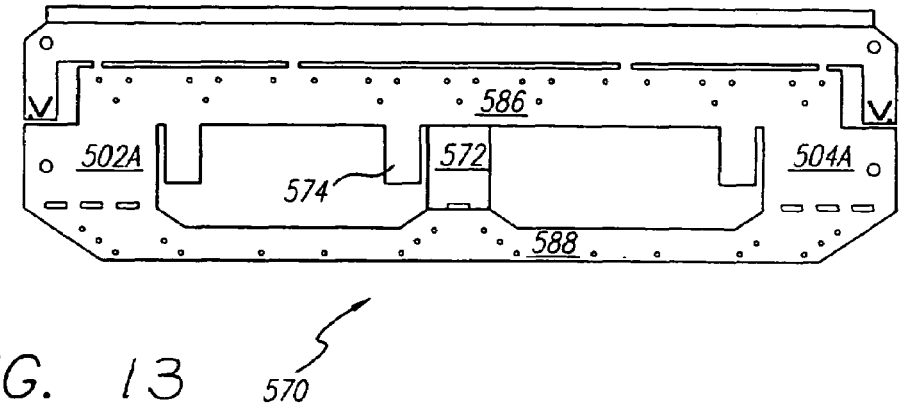
FIG. 13 is a top view of an alternate embodiment of a foundation bolt placement template according to the present invention.

Referring now to FIGS. 9(*a*)–(*c*), foundation bolt placement template 500 is one aspect of the present invention. Foundation bolt placement template 500 includes bolt platforms 502 and 504, inside plate 506, outside plate 508 and securing tabs 510 and 512 and bolt spacing tab 506A. Bolt platforms 502 and 504 are generally horizontal and include holes 503 and 505 respectively. Bolt spacing tab 506A includes holes 503A and 505A. Holes 503 and 505 are provided to hang foundation bolts such as bolt 516 through bolt platforms 502 and 504, supported by foundation bolt nuts such as nut 518, during fabrication of foundation 514. Holes 503A and 505A are provided to locate foundation bolts such as bolt 516 during fabrication of foundation 514. Bolt spacing tab 506A is separated from foundation bolt placement template 500 at separation points X, Y, and Z. Flap 509 is folded about 90° along fold line C–C'. Bolt spacing tab 506A is secured to form 501 as shown in FIG. 12. A bolt hung through hole 503 and 503A, or 505 and 505A will be controlled during concrete pouring an remain vertical. Bolt platforms 502 and 504 are separated by concrete access 511 which allows wet concrete to be easily poured through foundation bolt placement template 500 during fabrication of foundation 514. Outside plate 508 foldably joins bolt platforms 502 and 504 along indented and perforated fold line A–A'.

Figure 19A:
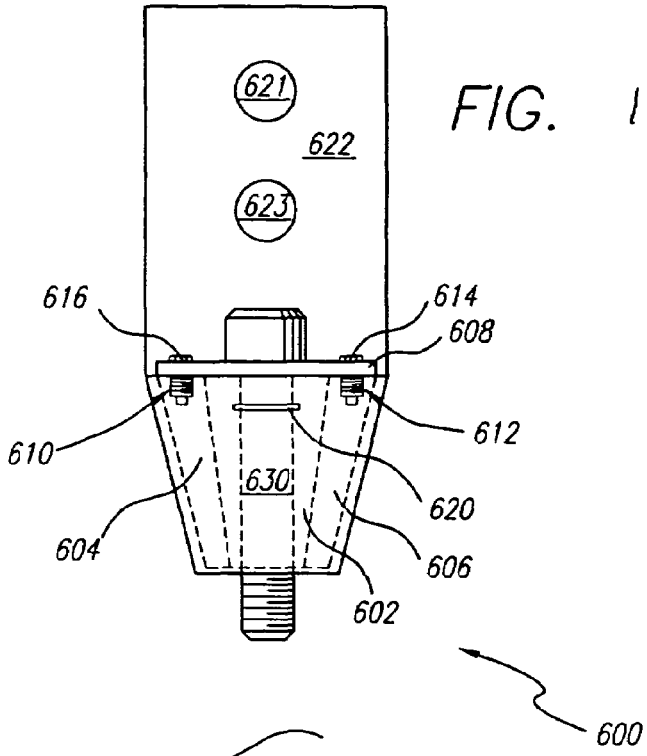
FIG. 19(*a*) is a front view of a self-tightening holdown according to the present invention.
Figure 19B:
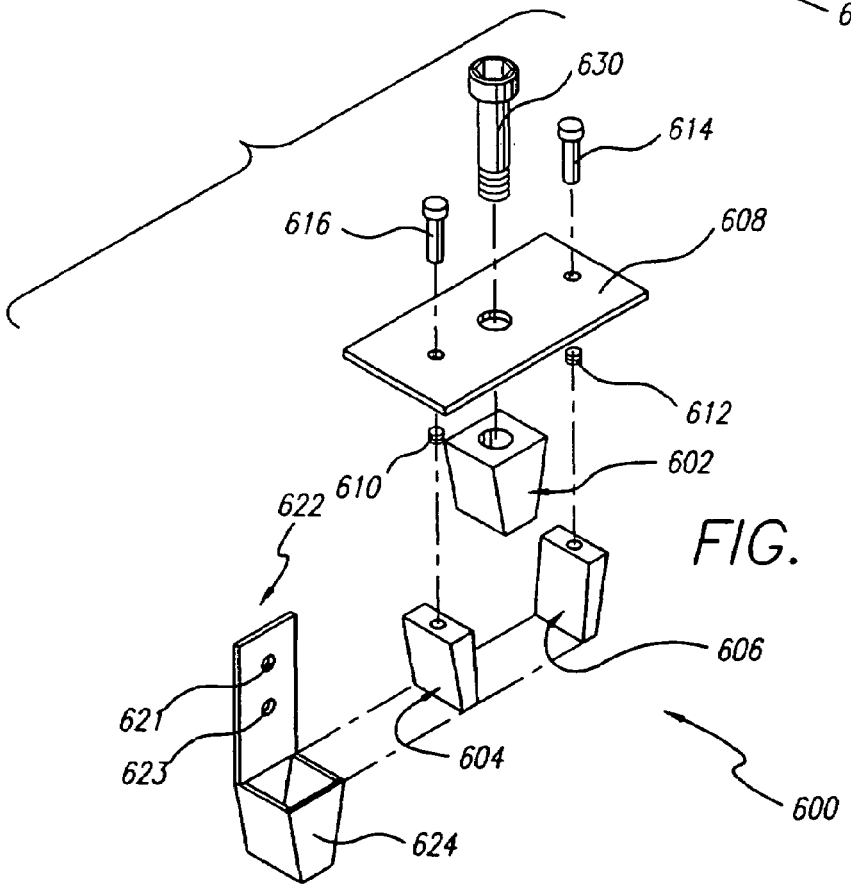

A plurality of fastener points 520 on outside plate 508 allow foundation bolt placement template 500 to be temporarily fastened to outside form 501 (also shown in FIGS. 19(*a*)–(*b*) and 20(*a*)–(*b*) below) during fabrication of foundation 514. Temporary attachment of foundation bolt placement template 500 to outside form 501 allows accurate placement of foundation bolt placement template 500 which supports foundation bolts such as bolt 516. Securing tabs 510 and securing tab 512 are captured within the wet concrete of foundation 514 during fabrication of foundation 514 and provide lateral force resistance at the frame-foundation interface after foundation 514 has hardened. After foundation 514 has hardened, temporary fasteners securing foundation bolt placement template 500 to outside form 501 may be removed to allow outside form 501 to be removed. Outside plate 508 may be folded about 90° along indented and perforated fold line A–A'. A rigid structural panel such as rigid structural panel 2 or 530 may be secured between inside plate 506 and outside plate 508 using a plurality of fasteners (not shown) through fastener points such as fastener point 520. Inside plate 506 is perpendicular to bolt platforms 502 and 504 and joins bolt platforms 502 and 504 along inside edge B–B'.

Referring now to FIGS. 11 and 12, foundation bolt placement templates 560 and 570 illustrate templates necessary to accommodate the wider lateral force resistance panels shown in FIGS. 7 and 8. As structural panels get wider a tie plate and adjacent securing tab are added for each vertical support in the panel. To accommodate rigid structural panel 300 tie plate 572 and securing tab 574 added. Tie plate 572 is added to connect inside plate 586 and outside plate 588 and to isolate vertical support 302 from the foundation. For the wider rigid structural panel 400, tie plates 572B and 576 and securing tabs 574B and 578 are added. The added securing tabs provide increased resistance to shear forces at the frame foundation interface.

Figure 17B:
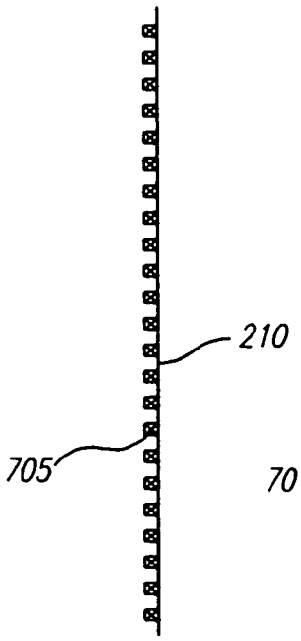
FIGS. 17(*a*)–(*b*) are two views of a reinforcing plate showing the bolt holes and the teeth.
Figure 17A:
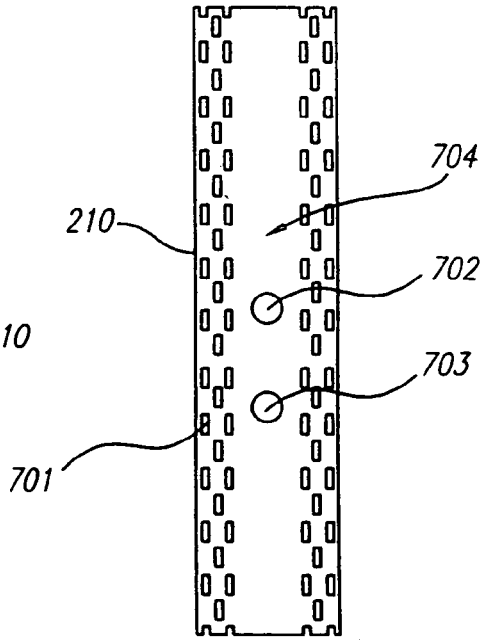

Referring now to FIGS. 17(*a*)–(*b*), reinforcing plate 700 is fabricated to have a plurality of teeth such as tooth 705 to secure reinforcing plate 700 in place. Punches such as punch 701 are made in reinforcing plate 700 to create teeth such as tooth 705. Area 704 adjacent to holes 702 and 703 respectively is free of punches 701.

Figure 14:
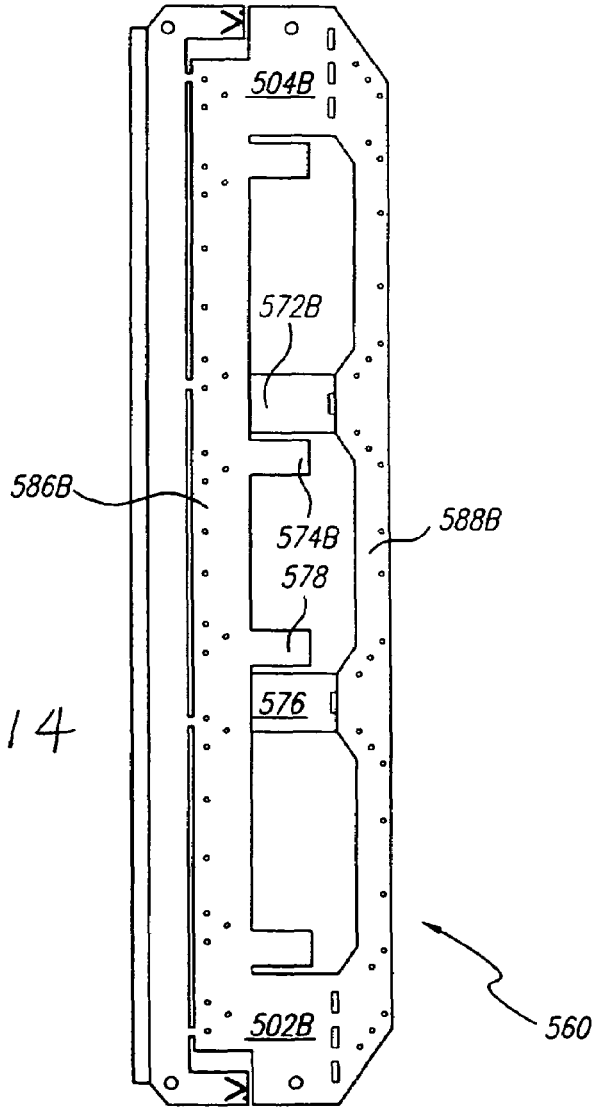
FIG. 14 is a top view of another alternate embodiment of a foundation bolt placement template according to the present invention.
Figure 15:
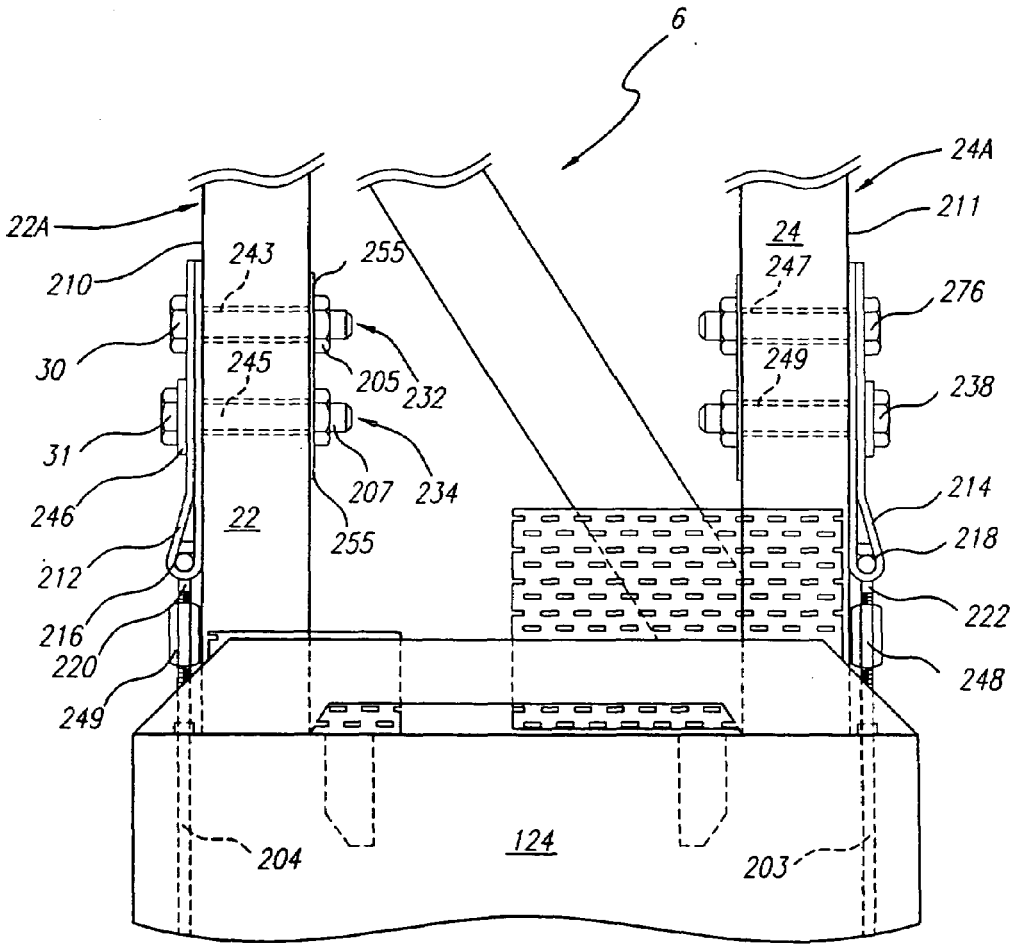
FIG. 15 is a detail view of the frame-foundation interface of FIG. 6.
Figure 16:
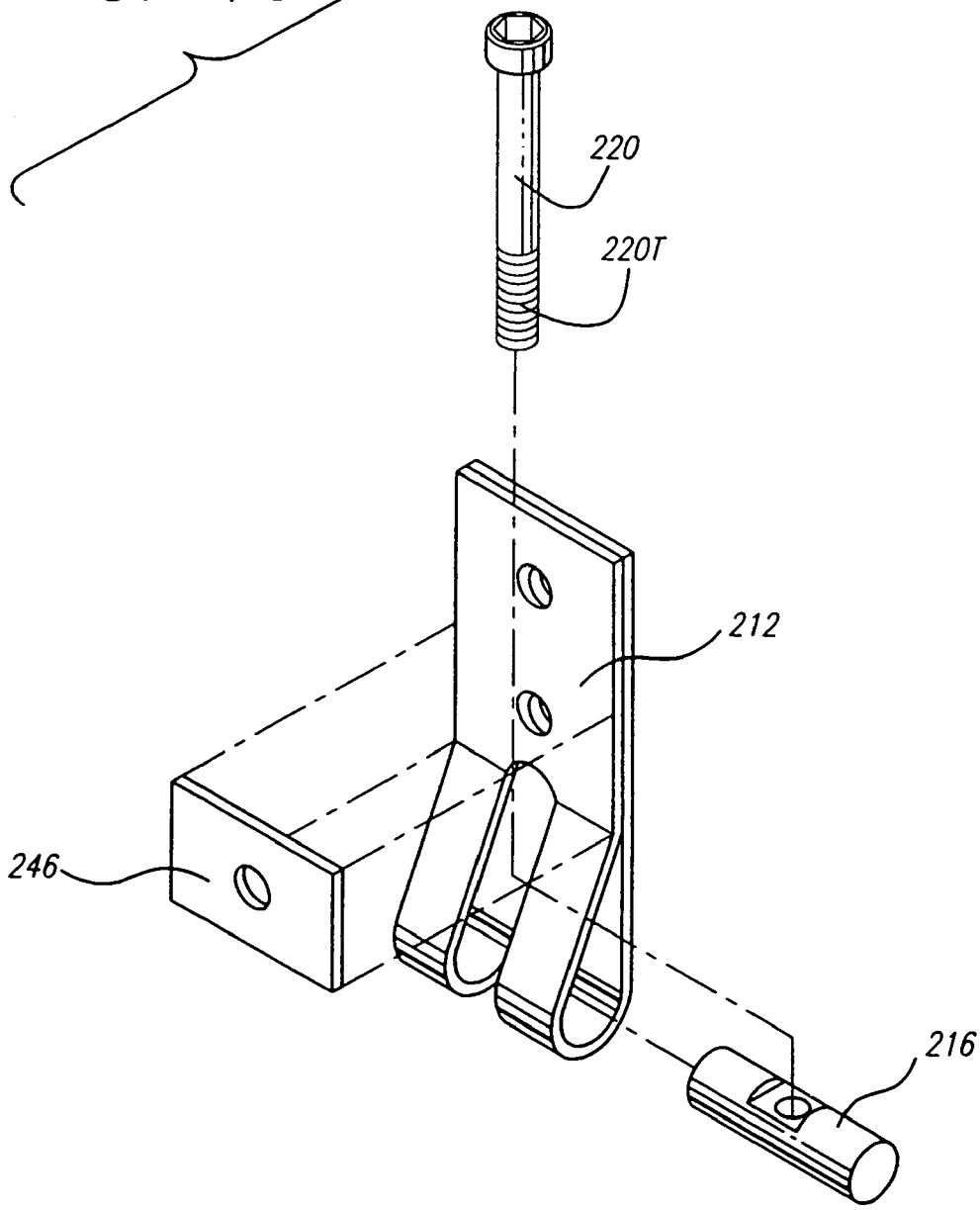
FIG. 16 is an exploded perspective view of the interconnection of some of the components of the holdown of FIG. 6.
Figure 18C:
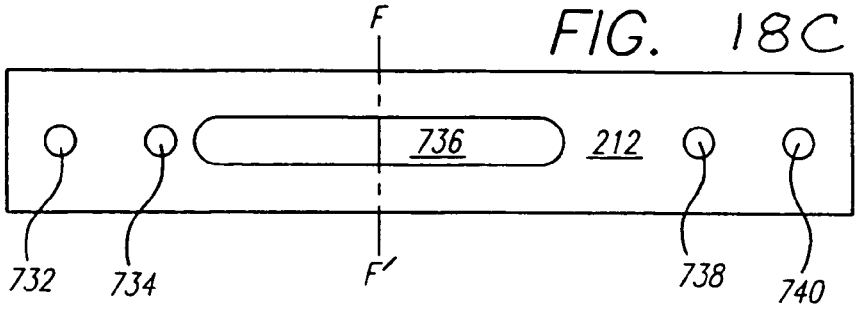
FIGS. 18(*a*)–(*c*) are views of the currently preferred embodiment of a holdown strap according to the present invention.
Figure 18B:
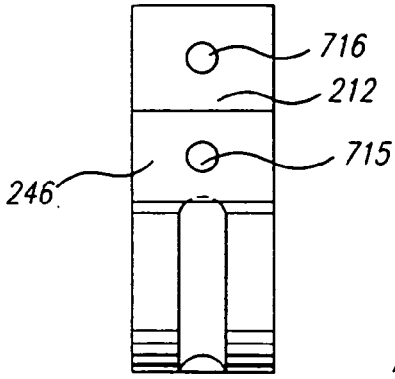
Figure 18A:
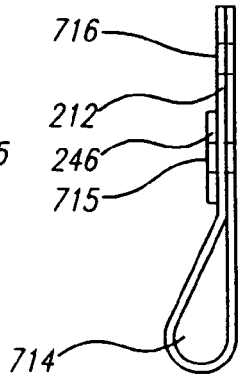

Referring now to FIG. 15 Rigid structural panel 2 is further secured to foundation 124 using holdowns such as holdown 6 and 8. In the currently preferred embodiment of the present invention, holdown straps 211 and 214 are folded metal strap of 3/16" steel, although any other suitable material may be used. Pin 216 and 218 fit within folded holdown straps 212 and 214 respectively. Holdown straps 211 and 214 are slotted, as shown in FIGS. 14 and 16(*a*)–(*c*), to accommodate holdown screws such as screws 220 and 222. Screws 220 and 222 extend perpendicular to the longitudinal axis of pins 216 and 218 respectively. The use of pins 216 and 218 and slots 212A and 214A permit screws 220 and 222 to rotate within the plane of rigid structural panel 2 and engage a holdown bolt that was not embedded perpendicular to the foundation. In a further aspect of the present invention, each holdown 6 and 8 is secured to rigid structural panel 2 using an upper bolt 30 and a lower bolt 31.

For first side member 22, upper bolt 31 penetrates holdown strap 212, first reinforcement plate 211, first side member 22, and sleeve 243. Threaded end 232 may be secured by nut 205 against a first plate washer 255. Lower holdown bolt 31 penetrates retaining plate 246, holdown strap 212, first reinforcement plate 211, side member 22, sleeve 245. Threaded end 234 may be secured by nut 207 against plate washer 255. Threaded end 220T of holdown screw 220 secures rigid structural panel 200 to foundation bolts such as bolts 203 and 204 by means of coupling nuts 248 and 249 which simultaneously engage holdown screw 222 and 220 and foundation bolt 203 and 204.

In another aspect of the present invention sleeves such as sleeve 243, 245, 247 and 249 are pressed through holes 9 in first side member 22 and second side member 24. The sleeves improve the load bearing capacity of side member 22 at the point of holdown attachment. The sleeves may be made of any rigid material, steel has proven to be the most effective yet tested. Exterior side member surfaces such as surface 22A and surface 24A which are penetrated by holes 9 are reinforced by having a reinforcing plate such as plate 210 and 211 pressed into the exterior surface of the side member over the location of holes 9. Teeth, such as tooth 705 in FIG. 17(*b*) secure reinforcing plates 210 and 211 to side member 22 and 24 respectively. Each reinforcing plate bolt hole 702 and 703 is concentric with imbedded sleeves such as sleeves 243 and 245 after sleeves 243 and 245 are pressed into a side member such as first side member 22. Reinforcing plates 210 and 211 prevent splitting of first side member 22 and second side member 24 when a load is applied to holdowns 6 and 8. Reinforcing plates 210 and 211 also prevent elongation of holes 9 by resisting shear applied by holdown 6 and 8 at surfaces 22A and 24A respectively. Central area 704 surrounds bolt holes 702 and 703 and is solid to improve the shear resistance and minimize hole elongation of reinforcing plates 210 and 211.

In the currently preferred embodiment of the present invention, holdown screws such as screw 220 are 5/8" steel capscrews having a tensile strength over 180,000 lbs. conforming to ASTM A574. Screw 220 is the principal means of transferring lateral loads to the foundation, therefore, the tensile strength may be selected for the maximum load expected.

Referring now to FIGS. 16(*a*)–(*c*), strap 710 is shown in detail. Folding strap 710 along F–F' forms a holdown such as holdown 6. Hole 732 is aligned with hole 740 and hole 734 is aligned with hole 738. Plate washer 712 is added for additional stability.

Referring now to FIGS. 17(*a*)–(*b*), self-tightening holdown 600 includes main wedge 602 and tightening wedges 604 and 606 within holdown pocket 624. Holster strap 622 is secured to a rigid structural panel or other structural element using holes 621 and 623. During installation, fasteners 614 and 616 secure plate 608 to tightening wedges 604 and 606 against the force of compression springs 610 and 612. After holdown 600 is installed, fasteners 614 and 616 are removed. Holdown screw 630 is attached to main wedge 602 by retaining clip 620. During cyclic lateral force loading, relative movement between holster strap 622 and holdown screw 630 that causes holdown screw 630 and main wedge 602 to lift out of holdown pocket 624 allows springs 610 and 614 to push tightening wedges 604 and 606 deeper into holdown pocket 624. This self-tightening action minimizes the cyclic loosening effect of cyclic loading on the lateral force resisting system.

Figure 20:
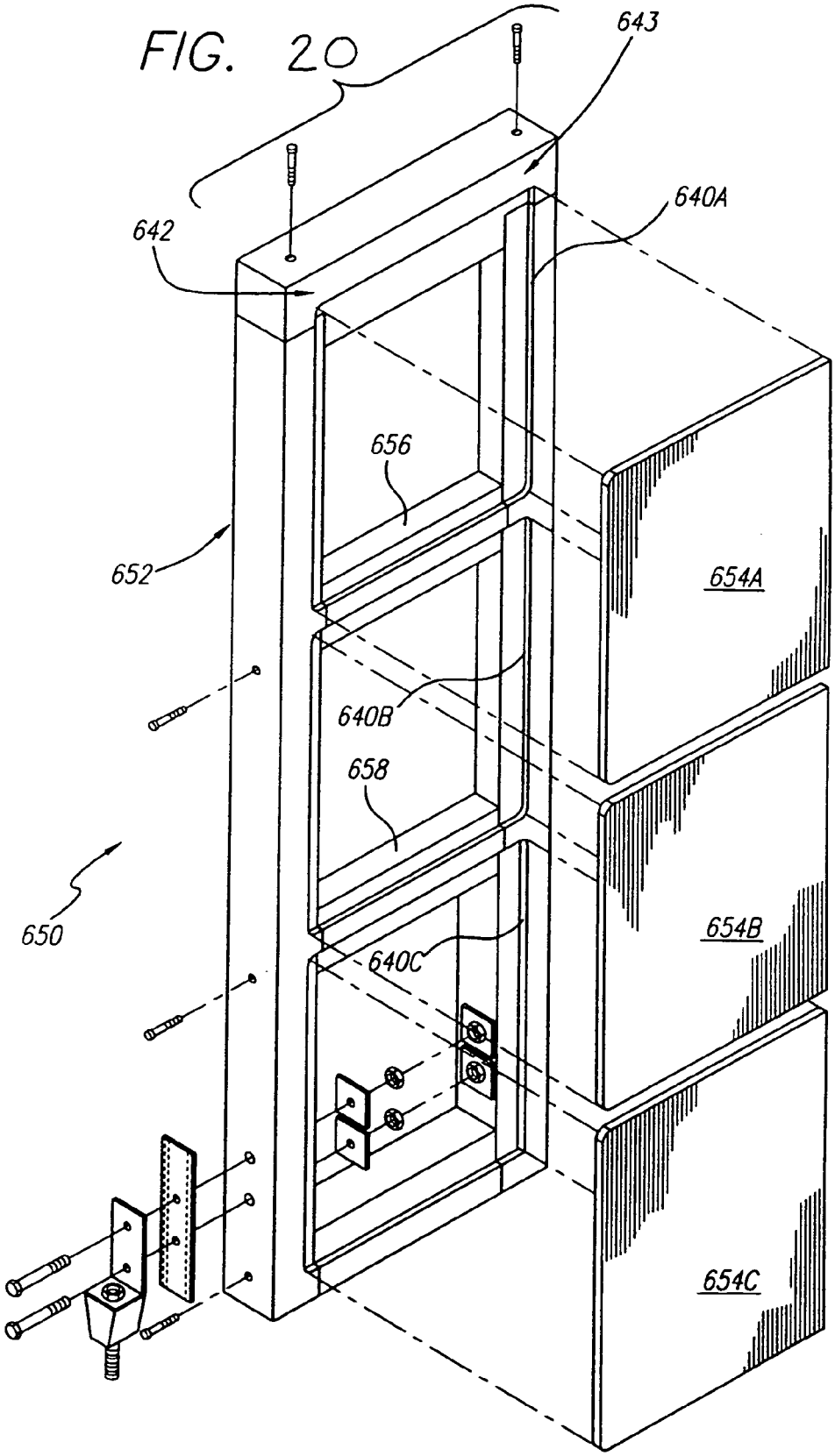
FIG. 20 is an exploded perspective view of another alternate embodiment of the present invention.

Referring now to FIG. 20, multi-pane panel 650 includes a plurality of panes 654A, 654B, and 654C vertically oriented in rigid structural frame 652 and horizontal members 656 and 658. This configuration permits more flexibility of the finished rigid structural panel under cyclic loads and yields more open load hysteresis curves. By using multiple vertically oriented panes the rigidity of multi-pane panel 650 may be tailored to meet specific needs. Vertically oriented panes may also be used in wide rigid structural panels such as rigid structural panel 300, 400 and rigid structural panel 2'. In a currently preferred embodiment of the present invention a rigid structural panel having vertically oriented panes, panes 654A, 654B, and 654C are oriented strand board (OSB) panes and are inset into dado 640A, 640B, and 640C respectively. Plates may be fastened over vertical joints 642 and 643 formed between panes 654A, 654B, and 654C and rigid structural frame 652 as discussed above.

Referring now to FIGS. 1A and 1B in another embodiment of the present invention, rigid structural panel 2' may incorporate one or more lateral resistance panes such as panes 654A', 654B', or 654C'. Lateral resistance panel 532" may be a single piece as shown or may be subdivided along A–A' to form panes 654A', 654B', and 654C'. A lateral resistance pane such as pane 654A' may have any suitable pattern configuration such as pattern 517.

Those skilled in the art will appreciate that the various adaptations and modifications of the just described preferred embodiment can be configured without departing from the scope and spirit of the invention. Therefore, it is to be understood that, within the scope of the appended claims, the invention may be practiced other than as specifically described herein.

We claim:

1. An apparatus comprising:

a structural panel having an outside edge and a plurality of holdown attachment points on the outside edge of the structural panel;

a plurality of deflection means to enable ductility of the structural panel;

a plurality of foundation bolts for embedding in a foundation or slab or stem wall and a foundation bolt placement template for defining a mounting location for the structural panel, and locating and supporting the foundation bolts during fabrication of the foundation or slab or stem wall; and means for attaching the structural panel holdown attachment points to the foundation bolts for transferring the lateral forces applied to the structural panel to the foundation or slab or stem wall.

2. The apparatus of claim 1 wherein the means for attaching the structural panel to the foundation bolts further comprises:

a plurality of holdowns for transferring the shear forces developed in the structural frame to the foundation bolts, each holdown attached to at least one holdown attachment point, each holdown securing the structural panel to a foundation bolt.

3. The apparatus of claim 1 wherein the structural panel further comprises:

a generally rectangular structural frame having two coplanar vertical side members connected by two or more coplanar horizontal members forming a generally rectangular opening therebetween, each vertical side member having an inside surface and an outside surface;

a plurality of holdown attachment points on each vertical side member;

one or more lateral force resisting members connected to the structural frame to resist lateral forces applied to the structural frame; and a plurality of deflection means in the one or more lateral force resisting members to enable ductility of the structural panel.

4. The apparatus of claim 3 wherein the one or more lateral force resisting members comprise:

one or more horizontal spacing members coplanar to and connecting the vertical side members subdividing the generally rectangular opening forming two or more subopenings; and one or more generally rectangular panels connecting each vertical side member at a vertical joint, the panel covering the two or more subopenings.

5. The apparatus of claim 3 wherein the one or more lateral force resisting members is metal.

6. The apparatus of claim 3 wherein the one or more lateral force resisting members comprise:

a plurality of generally rectangular coplanar panels attached to and connecting adjacent vertical members at a vertical joint, each panel covering a horizontally adjacent, generally rectangular opening.

7. The apparatus of claim 6 wherein the plurality of panels are attached to the vertical members using a plurality of fasteners securing each panel to each vertical member.

8. The apparatus of claim 1 wherein the plurality of deflection means are arranged in a pattern.

9. The apparatus of claim 8 wherein the pattern of deflection means includes one or more linear patterns.

10. The apparatus of claim 8 wherein the pattern of deflection means includes two or more parallel linear patterns.

* * * * *